United States Patent [19]

Hamai

[11] Patent Number: 4,693,692

[45] Date of Patent: Sep. 15, 1987

[54] APPARATUS FOR MANUFACTURING SMALL-SIZE GAS-FILLED LAMPS

[75] Inventor: Jitsuo Hamai, Tokyo, Japan

[73] Assignee: Hamai Electric Lamp Co., Ltd., Tokyo, Japan

[21] Appl. No.: 898,290

[22] Filed: Aug. 20, 1986

Related U.S. Application Data

[62] Division of Ser. No. 568,850, Jan. 6, 1984, Pat. No. 4,627,824.

[30] Foreign Application Priority Data

| | | | |
|---|---|---|---|
| Jan. 12, 1983 | [JP] | Japan | 58-3872 |
| Jan. 12, 1983 | [JP] | Japan | 58-3874 |
| Jan. 12, 1983 | [JP] | Japan | 58-3875 |
| Jan. 12, 1983 | [JP] | Japan | 58-3876 |
| Jan. 12, 1983 | [JP] | Japan | 58-3880 |

[51] Int. Cl.[4] ..... H01J 9/18; H01J 9/38

[52] U.S. Cl. ..... 445/66; 445/27; 445/39

[58] Field of Search ..... 445/27, 43, 66, 67, 445/69, 70, 39

[56] References Cited

U.S. PATENT DOCUMENTS

| | | | |
|---|---|---|---|
| 2,549,359 | 4/1951 | Bakanau | 445/67 |
| 2,553,749 | 5/1951 | Clark | 445/66 |
| 3,040,204 | 6/1962 | Belknap . | |
| 3,208,812 | 9/1965 | Brundige et al. . | |
| 3,460,219 | 8/1969 | Shiragaki | 445/27 |
| 3,589,790 | 6/1971 | Beane et al. . | |
| 3,704,927 | 6/1972 | Toomey et al. . | |
| 3,716,285 | 2/1973 | Boyce | 445/27 |
| 3,788,724 | 1/1974 | Schenkels | 445/39 |
| 3,854,786 | 12/1974 | Noteltiers et al. . | |
| 3,884,540 | 5/1975 | Hamai | 445/27 |
| 3,967,871 | 7/1976 | Kerekes . | |
| 4,578,043 | 3/1986 | Teshima | 445/43 |

*Primary Examiner*—Kurt Rowan

*Attorney, Agent, or Firm*—Flynn, Thiel, Boutell & Tanis

[57] ABSTRACT

A lamp bulb has a closed lens-shaped head received in a recess in a bulb holder jig and an open end held by a heating carbon jig. A bead supporting a pair of lead wires with a filament connected thereto is disposed in the open end of the bulb, with the lead wires being supported on a lead wire holder. The jigs and holder are housed in a chamber in which a vacuum is developed. A gas to be filled in the bulb is introduced into the chamber under a desired pressure irrespective of atmospheric pressure. Then, an electric current is passed through the heating carbon jig to heat the latter for fusing the open end of the bulb and the bead, and at the same time the closed end of the bulb is cooled by the bulb holder jig which is supplied with a coolant liquid. After the bulb and the bead have been fused together, the electric current flowing through the heating carbon jig is cut off to stop the heating of the heating carbon jig. Then, the chamber is removed, and the completed lamp is taken out. A number of such gas-filled lamps can easily be mass-produced by placing the lamp components in the chamber at a time, without producing defective products.

3 Claims, 6 Drawing Figures

APPARATUS FOR MANUFACTURING SMALL-SIZE GAS-FILLED LAMPS

This is a division of application Ser. No. 568,850 filed Jan. 6, 1984, now U.S. Pat. No. 4,627,824.

BACKGROUND OF THE INVENTION

1. Field of the Invention

The present invention relates to a method of and apparatus for manufacturing small-size gas-filled lamps, particularly small-size halogen-gas-filled lamps, for use in optical instruments, medical instruments, electronic devices and the like.

2. Description of the Prior Art

It has been customary practice to manufacture small-size gas-filled lamps by sealing a bead attached a filament in a bulb manually with a gas burner, connecting the assembly to a vacuum source to develop a vacuum in the bulb, introducing a gas such as of argon, nitrogen, or krypton, for example, into the bulb, and finally burning off the tip through which the air was discharged and the gas was filled, using a gas burner. According to a present mechanized manufacuring process, the manual steps are replaced with mechanical operations which are effected individually at angularly spaced positions around an indexing table as the latter intermittently rotates for thereby assembling lamps one by one.

There has been proposed a method of simultaneously manufacturing a multiplicity of small-size gas-filled lamps. With this method, a heater is attached to an outer wall of a tunnel-shaped chamber in which a vacuum is developed or a gas is introduced, bulbs and beads with filaments attached are mounted on jigs in the chamber, and the jigs are pulled along by a wire while the bulbs and beads assembled into lamps. This method is however limited to applications where a gas at atmospheric pressure or lower pressure is filled.

The manual or mechanized fabrication process is normally performed in atmosphere. If the gas pressure in the lamp bulb were higher than atmospheric pressure, then the gas would be blown out when the tip is burned off after the gas has been filled. Therefore, it is impossible to fill gas at higher pressure in the lamp. If the tunnel-shaped chamber with the heater attached to its outer wall were heated, it would be highly dangerous since the chamber itself would be heated, and the jigs and the entire chamber would have to be heated. The gas filled in the lamp bulbs would then become poor in purity due to an impure gas generated by the heated chamber and jigs.

In the manufacture of halogen lamps or the like, the active gas such as halogen gas produces compounds through reaction with a furnace and jigs which are heated to high sealing temperature, and no prescribed percentage of halogen gas cannot be filled in lamps. To avoid this difficulty, it is current practice to make halogen-gas-filled lamps by fabricating bulb and filament assemblies one by one at angularly spaced positions around an indexing table according to the known mechanized process. After a halogen gas has been filled, the gas introduction tube is sealed for a length greater than the required sealed portion, and then the lamp portion of the bulb is cooled by liquid nitrogen to transfer the halogen gas from the gas introduction tube into the bulb at an enriched state under a pressure lower than atmospheric pressure. Thereafter, the prescribed sealed portion is burned off by a gas burner.

As described above, the presently available methods of manufacturing small-size gas-filled lamps suffer from various problems, and has complicated steps. The lamps manufactured by such methods are unstable in quality. The methods have therefore been unsatisfactory for mass-producing lamps of good quality.

SUMMARY OF THE INVENTION

With the difficulties of the prior methods and apparatus in view, it is an object of the present invention to provide a method of and an apparatus for manufacturing many, 500 to 1,000 or more, small-size gas-filled lamps of improved uniform quality at a time in simple mechanized operation without producing defective products during the manufacturing process.

According to the present invention, bulbs are mounted on a bulb holder jig with semispherical heads of the bulbs being received respectively in holes in the bulb holder jig, and beads having lead wires and filaments are disposed in open sealing ends of the bulbs, the open sealing ends being surrounded by a heating carbon jig and the lead wires being supported on a lead wire holder disposed above the heating carbon jig. The assembly is placed in a pressurized chamber in which a vacuum is developed. An electric current is then passed through the heating carbon jig to allow a gas to be emitted from the chamber, the jigs, and the holder. When the atmosphere in the chamber becomes uniform and the vacuum reaches a prescribed level, the vacuum valve is closed and a sealing gas such as of argon, krypton, or halogen is introduced into the chamber and kept under a prescribed pressure therein. Thereafter, the current flowing through the heating carbon jig is increased, and the bulb holder jig starts being cooled. When the temperature of the heating carbon jig is raised to the point where the open sealing end of the bulb and the bead reach a softening point, the bulb holder jig is rapidly cooled and the current through the heating carbon jig is increased to heat the heating carbon jig up to higher temperature to fuse the open sealing end of the bulb and the bead. Thereafter, the current is cut off to stop the heating of the heating carbon jig. After the temperature in the chamber is lowered down to a prescribed temperature, the gas is discharged from the chamber to keep the interior thereof at atmospheric pressure, and a number of completed lamps are taken out of the chamber.

With the arrangement of the invention, the pressure of the gas filled in the bulbs is the same as that in the chamber, and any increase in the pressure of gas due to gas expansion under sealing heat remains the same in the bulb and chamber. Since the bulb is cooled intensively immediately prior to the sealing of the bulb end and the bead, the gas in the bulb is contracted and lowered in pressure, there is no danger of the gas being blown out of the bulb. Therefore, the bulb end and the bead can easily and simply be sealed together. The pressure of any introduced gas can be selected as desired in a wide range. The arrangement of the invention is particularly useful when filling a gas in a lamp bulb at a pressure higher than atmospheric pressure.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
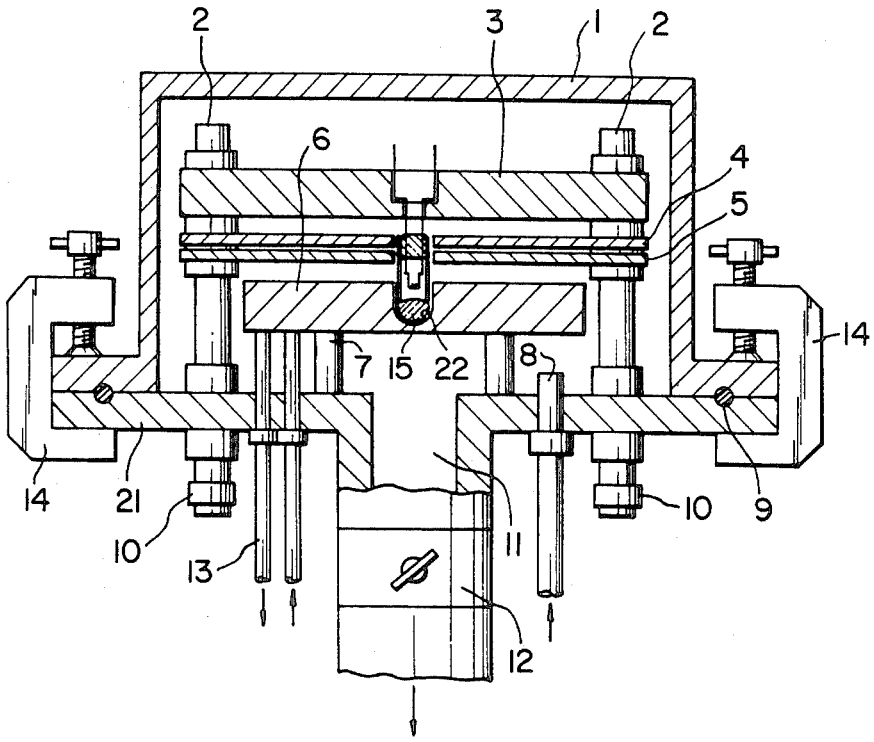
FIG. 1 is a front elevational view, partly in cross section, of an apparatus for manufacturing small-size gas-filled lamps according to the present invention.

As shown in FIG. 1, an apparatus for manufacturing small-size gas-filled lamps according to the present invention includes a pressurized vacuum chamber 1 made of steel plated with hard chromium. An insulating material may be or may not be attached to an interior surface of the chamber 1 dependent on the product to be heated and sealed therein. In the illustrated embodiment, the chamber 1 is constructed of walls which are about 20 mm thick, and can sufficiently seal therein the gas pressure of the order of 20 atmosphere. Heating electrodes 2 are housed in the chamber 1. Each of the heating electrodes 2 is made of copper plated with nickel by electroless plating. Support columns of copper which can be introduced for supplying currents to the electrodes may be or may not be water-cooled dependent on the product to be heated and sealed. The chamber 1 houses therein a lead wire holder 3 mounted on the heating electrodes 2 for positioning the center of a lamp filament in alignment with the central axis of a lamp assembled. If the flament were displaced out of the central axis of a lamp having a lens mounted on the tip thereof, the focus of the lens would be adversely affected thereby, resulting in a defective product. The lead wire holder 3 also serves to attach a bead on which a filament is mounted accurately at a sealing position in an open end of a bulb.

A heating carbon jig 4 is mounted on the heating electrodes 2 for fusing and sealing the bead with the filament attached and the open end of the bulb. The heating carbon jig 4 is in the form of a plate having a central hole of a diameter slightly larger than the outside diameter of the bulb, so that the edge defining the central hole will be kept in substantial contact with the outer circumferential surface of the sealing portion of the bulb. Although not shown, the heating carbon jig 4 has a number of thermal barrier slots or holes positioned between the heating electrodes 2 and the central hole for heating a multiplicity of bulbs attached to uniform temperature.

A thermal shield plate 5 is disposed immediately below the heating carbon jig 4 with a small space therebetween. The thermal shield plate 5 serves to prevent the heat emitted by the heating carbon jig 4 from heating a bulb holder jig 6 (described later) and a bulb supported thereon to the extent where the bulb is deformed or the gas in the bulb is expanded due to a temperature rise of the bulb holder jig 6. The thermal shield plate 5 also prevents other portions of the bulb than the sealing portion from being heated, thus eliminating any impure gas which would otherwise be generated by the undue heating of the bulb and hence maintaining the desired purity of the gas filled in the bulb.

The bulb holder jig 6 is positioned below the thermal shield plate 5 and centrally in the chamber 1 for supporting a bulb 15 thereon. The bulb holder jig 6 has an array of recesses 22 for receiving the heads, respectively, of bulbs 15. The bulb holder jig 6 is centrally aligned with the lead wire holder 3. The bulb holder jig 6 may be or may not be cooled. Where the bulb holder jig 6 is cooled, it can be cooled by water or other coolants such as Freon at particularly lower temperatures.

The bulb holder jig 6 is mounted by supports 7 on a base 21 so as to be securely positioned in the chamber 1. The supports 7 are made of a thermally insulating material. The bulb holder jig 6 is supported by the supports 7 in upwardly spaced relation to an air outlet tube 11. The air outlet tube 11 is connected to an air discharging vacuum pump through a valve 12 which will be opened when developing a vacuum in the chamber 1 and closed when introducing a gas into the chamber 1. A gas to be filled in the bulb can be introduced under a desired pressure through a gas supply tube 8 mounted on the base 21. A sealing O-ring 9 made of thermally insulating rubber is interposed between peripheral edges of the chamber 1 and the base 21 for providing a seal therebetween. Wire cord attachment nuts 10 serve to attach wire cords from a power supply to the heating electrodes 2. Coolant liquid tubes 13 are mounted on the base 21 and coupled to the bulb holder jig 6 for cooling the bulbs supported on the latter. The peripheral edges of the chamber 1 and the base 21 are sealingly clamped with the O-ring 9 interposed therebetween by clamps 14.

The apparatus shown in FIG. 1 will be assembled in the following manner: Bulbs 15 are set in place on the bulb holder jig 6 and lead wires to which beads and filaments are attached and which are bent are supported on the lead wire holder 3. At this time, the beads are received in the bulbs 15 which are placed in the holes in the heating carbon jig 4 and the thermal shield plate 5. Then, the chamber 1 is placed on the base 21 with the O-ring 9 interposed between their peripheral edges, which are firmly clamped together by the clamps 14. The valve 12 disposed in the air dischare tube 11 connected to the vacuum pump is opened to develop a vacuum in the chamber 1. Then, the heating carbon jig 4 is heated to heat the interior of the chamber 1 up to a temperature ranging from about 100° C. to about 200° C. for discharge any impure gas from the chamber 1 to achieve a higher vacuum. When the vacuum has reached a prescribed level, the valve 12 is closed.

Figure 2:
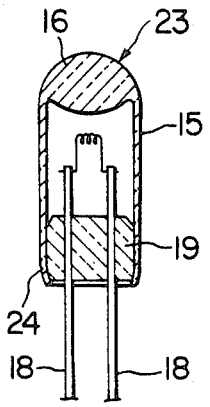
FIG. 2 is a cross-sectional view of a small-size gas-filled lamp manufactured by the apparatus shown in FIG. 1.
Figure 6:
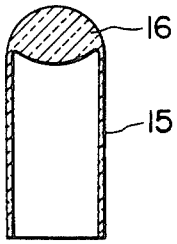
FIG. 6 is a cross-sectional view of a lamp bulb having a lens end.

FIG. 2 shows a completed small-size gas-filled lamp 23 manufactured according to a method of the present invention. The lamp 23 includes an outer bulb 15 made of glass and having a sealing end 24 and an opposite end or top 16 in the form of a semispherical lens, as shown in FIGS. 2 and 6. The lamp 23 also includes a pair of lead wires 18 supported on a bead 19 disposed and sealed in the sealing end 24 of the bulb 15, the lead wires 18 comprising Dumet or molybdenum wires and having the same coefficient of thermal expansion as that of the bead 19. The bead 19 is of a diameter slightly smaller than the inside diameter of the bulb 15, and is made of the same glass as that of the bulb 15. A coiled filament 17 is attached to the ends of the lead wires 18 which are disposed in the bulb 15.

A method of manufacturing the lamp 23 will be described with reference to FIGS. 2 through 6.

Figure 3:
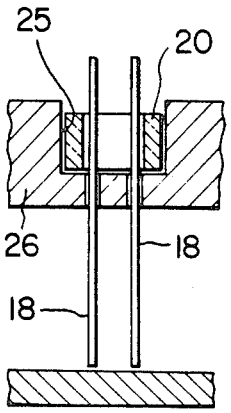
FIG. 3 is a fragmentary cross-sectional view illustrative of a pair of lead wires as it is assembled by a bead.
Figure 4:
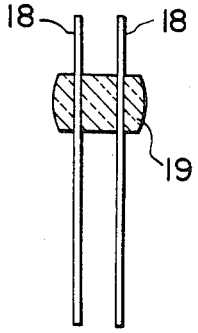
FIG. 4 is a cross-sectional view of the assembled lead wires and bead.
Figure 5:
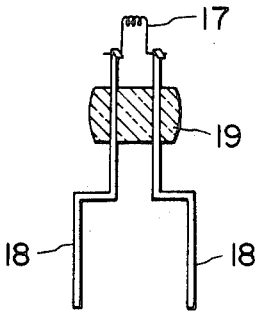
FIG. 5 is a cross-sectional view of the lead wire and bead assembly with a filament attached to the lead wires, the lead wires being shaped for positioning the filament and bead in sealing operation.

The outer bulb 15 is formed by cutting off an elongate tube of glass and shaping one end of the cut piece into the semispherical mass of glass. Then, a tube of the same glass is also severed into a bead ring 20 (FIG. 3) which is placed in a recess 25 in a jig 26 of carbon with a pair of straight lead wires 18 extending parallel to each other through the bead ring 20. The jig 26 is then heated to fuse the bead ring 20 into a bead 19 around the lead wires 18 as illustrated in FIG. 4. Then, longer end portions of the lead wires 18 are bent, and a filament 17 is attached to bent ends of the shorter end portions of the lead wires 18 as shown in FIG. 5. The filament 17 is placed in an atmosphere of hydrogen, and an electric current is passed through the filament 17 to remove any impurities deposited on the filament 17. The assembly of FIG. 5 and the bulb 15 are placed in the chamber 1 clamped to the base 21 as shown in FIG. 1, and a gas to be filled in the bulb 15 is introduced into the chamber 1 by opening the valve 12. The gas is supplied into the chamber 1 at a pressure slightly higher than a prescribed pressure to compensate for any pressure drop in the bulb 15 below the gas pressure in the chamber 1 due to expansion of the gas at the time the bulb 15 is heated and sealed. Then, the valve 12 is closed. An electric current is passed through the heating carbon jig 4 to heat the latter. Where the pressure of the gas filled in the bulb 15 is to be increased, the coolant liquid is introduced through the coolant liquid tubes 13 for cooling the bulb holder jig 6. Then, the current passing through the heating carbon jig 4 is increased to heat the bulb 15 and the bead 19 to the temperature where they are melted and fused together. Immediately before the bulb 15 and the bead 19 are sealed together, the amount of coolant liquid fed into the bulb holder jig 6 is also increased to cool the bulb 15 more intensively to suppress the expansion of the gas in the bulb 15, and at the same time the heating carbon jig 4 is heated up to a higher temperature to seal the bulb 15 and the bead 19 together. After the bulb 15 and the bead 19 have been sealed, the electric current supplied to the heating carbon jig 4 is immediately cut off to stop the heating thereof. The bulb holder jig 6 is continuously cooled by the coolant liquid until the temperature in the chamber 1 is lowered down to a desired temperature, whereupon the forced cooling of the bulb holder jig 6 is stopped. Then, the bulb holder jig 6 is slowly cooled until the temperature in the chamber 1 becomes low enough to allow the completed product to be picked up. The clamps 14 are then unlocked, the chamber 1 is removed, and the finished lamp 23 is removed. One cycle of the process is now completed.

Examples of the present invention will now be described.

EXAMPLE 1

Small-size lamp filled with an argon gas were manufactured which have a rated voltage of 3 V, a rate current of 500 mA, an outside diameter of 3 mm, and an overall length of about 8 mm. The lamps had outer bulbs made of soft lead glass and processed at a temperature in the range of from about 650° C. to 700° C. The lead wires comprised Dumet wires, and the bead rings were cut off from the same tube of glass from which the bulbs were severed. The bead rings and lead wires were assembled as shown in FIG. 3 on the jig 26, and heated to a temperature ranging from 800° C. to 850°C. in the atmosphere of a nitrogen gas. 500 to 1,000 bead-and-lead-wire assemblies were manufactured in one process. The lead wires were bent at lower end portions and filaments were attached to upper ends of the lead wires as illustrated in FIG. 5. Then, about 500 such assemblies were placed centrally in the heating carbon plate 4 as shown in FIG. 1, and air was discharged from the chamber 1 to create a vacuum therein. Then, the chamber 1 and the base 21 were clamped together by the clamps 14. An electric current was passed through the heating carbon jig 6 to heat the latter and hence the interior of the chamber 1 up to a temperature in the range of from about 300° C. to 400° C. for removal of any gas deposited in the chamber 1, thereby achieving a higher degree of vacuum. When the vacuum reached $10^{-6}$ mmHg or higher, the valve 12 was closed, and an argon gas was introduced through the gas supply tube 8 up to the pressure of 2.5 atmosphere. Then, the current passing through the heating carbon plate 4 was increased to heat the same up to a temperature of about 760° C. for thereby fusing the beads and the outer bulbs together, whereupon the current was cut off to stop the heating of the heating carbon plate 4.

When the temperature in the chamber 1 dropped to 200° C. or below, the clamps 14 were removed to detach the chamber 1 from the base 21, and completed small-size lamps filled with an argon gas with the outer bulbs and beads being fused together were taken out. The overall process was thus completed. The pressure of the gas in the finished lamp under normal temperature was about 1.2 atmosphere. All of the produced lamps were found good as a result of a lighting test, a current test and a flux test.

EXAMPLE 2

Small-size halogen lamp filled with a mixed gas of krypton and methylene bromide were manufactured which have a rated voltage of 6 V, a rate current of 1 A, an outside diameter of 4.7 mm, and an overall length of about 11 mm. The lamps had outer bulbs made of soft lead glass and processed at a temperature in the range of from about 650° C. to 700° C. The lead wires comprised molybdenum wires, and the bead rings were cut off from the same tube of glass from which the bulbs were severed. The bead rings and lead wires were assembled as shown in FIG. 3 on the jig 26, and heated to a temperature ranging from 1,200° C. to 1,250° C. in the atmosphere of a nitrogen gas. 200 to 500 bead-and-lead-wire assemblies were manufactured in one process. The lead wires were bent at lower end portions and filaments in the form of a tungsten coil having an increased purity for use in halogen lamps were attached to upper ends of the lead wires as shown in FIG. 5. Then, about 300 such assemblies were placed centrally in the heating carbon plate 4 as shown in FIG. 1 within the chamber 1 having a thermal insulator plate disposed therein, and air was discharged from the chamber 1 to create a vacuum therein. Then, the chamber 1 and the base 21 with the O-ring 9 interposed therebetween were clamped together by the clamps 14. An electric current was passed through the heating carbon jig 6 to heat the latter and hence the interior of the chamber 1 up to a temperature in the range of from about 150° C. to 200° C. for removing any gas deposited in the chamber 1, thereby achieving a higher degree of vacuum. When the vacuum reached $10^{-6}$ mmHg or higher, the valve 12 was closed, and a mixed gas of krypton and methylene bromide was introduced through the gas supply tube 8 up to the pressure of 5 atmosphere. Instead of such a gas, a mixed gas composed of an inert gas and a halogen gas, such as an argon gas and an iodine gas may be introduced. The current flowing through the heating electrodes was increased to raise the heating temperature, and at the same time cooling water was introduced into the bulb holder jig 6 to prevent the bulbs and the gas therein from being heated to a high temperature. Then, the current passing through the heating electrodes 2 was increased to heat the heating carbon jig 6 up to a temperature of about 1,200° C. Immediately before the beads and the outer bulbs were fused together, the cooling water being supplied to the bulb holder jig 6 was increased to further cool the latter, and the current was increased to fuse the beads and the bulbs together, whereupon the current was cut off to stop the heating of the heating carbon plate 4.

The quantity of cooling water flowing through the bulb holder jig 6 is slightly reduced. When the temperature in the chamber 1 dropped to 200° C. or below, the clamps 14 were removed to detach the chamber 1 from the base 21, and completed small-size halogen lamps filled with an argon gas with the outer bulbs and beads being fused together were taken out. The overall process was thus completed. The pressure of the gas in the finished lamp under normal temperature was about 3 atmosphere. After going through an aging process, all of the produced lamps were found good as a result of a current test, a flux test, and a life test.

With the method of the present invention, as described above, the outer bulb and the bead with the filament attached can easily and simply be fused together, and no defective lamps are produced. The cost of manufacture of small-size gas-filled lamps is reduced, and the quantity of such lamps produced in an unit area during a unit time is much greater than that according to the conventional processes. Therefore, the method of the present invention is of great industrial advantage.

Although a certain preferred embodiment has been shown and described, it should be understood that many changes and modifications may be made therein without departing from the scope of the appended claims.

What is claimed is:

1. An apparatus for manufacturing at least one gas-filled lamp from an assembly of a bulb having a closed head and an open end, and a bead disposed in the open end of the bulb and supporting a pair of lead wires with a filament connected thereto, said apparatus comprising:

(a) a base;
(b) a chamber mounted on said base;
(c) a bulb holder jig disposed on said base and housed in said chamber and having a recess for receiving the closed end of the bulb;
(d) a lead wire holder disposed in said chamber for supporting the lead wires;
(e) a heating carbon jig disposed in said chamber bewteen said lead wire holder and said bulb holder jig for holding the open end of the bulb with the bead positioned therein;
(f) electrodes mounted in said chamber and electrically connected to said heating carbon jig for supplying an electric current to said heating carbon jig to heat the latter;
(g) a gas supply tube mounted on said base for introducing a gas to be filled in the bulb into said chamber;
(h) an air outlet tube mounted on said base for developing a vacuum in said chamber; and
(i) coolant liquid tubes mounted on said base for supplying a coolant liquid to said bulb holder jig.

2. An apparatus according to claim 1, further including a thermal shield plate interposed between said bulb holder jig and said heating carbon jig.

3. An apparatus according to claim 1, further including a plurality of clamps for clamping together peripheral edges of said base and said chamber, and an O-ring disposed between said peripheral edges.

* * * * *